US006978975B1

(12) United States Patent
Magnusson

(10) Patent No.: US 6,978,975 B1
(45) Date of Patent: Dec. 27, 2005

(54) LOCKABLE SHELF BRACKET

(75) Inventor: Reine Magnusson, Västervick (SE)

(73) Assignee: ELFA Sweden AB, Västervik (SE)

( * ) Notice: Subject to any disclaimer, the term of this patent is extended or adjusted under 35 U.S.C. 154(b) by 0 days.

(21) Appl. No.: 10/111,902

(22) PCT Filed: Oct. 25, 2000

(86) PCT No.: PCT/SE00/02079

§ 371 (c)(1),
(2), (4) Date: Jul. 17, 2002

(87) PCT Pub. No.: WO01/32055

PCT Pub. Date: May 10, 2001

(30) Foreign Application Priority Data

Nov. 2, 1999 (SE) ..... 9903969

(51) Int. Cl.[7] ..... A47G 29/02; E04G 3/08; E06B 7/28

(52) U.S. Cl. ..... 248/249; 248/235; 248/250

(58) Field of Search ..... 248/235, 241, 248/243, 247, 248, 249, 250, 222.13; 211/87.01, 211/153, 186, 187; 108/108, 107, 106; 312/408

(56) References Cited

U.S. PATENT DOCUMENTS

| | | | | | |
|---|---|---|---|---|---|
| 836,045 | A | * | 11/1906 | Melchoir | 248/243 |
| 857,543 | A | * | 6/1907 | Thomas | 248/243 |
| 1,764,766 | A | * | 6/1930 | White | 248/243 |
| 1,831,550 | A | * | 11/1931 | Vanderveld | 248/243 |
| 2,274,125 | A | * | 2/1942 | Carney | 211/153 |
| 2,498,623 | A | * | 2/1950 | Poupitch | 248/235 |
| 2,534,952 | A | * | 12/1950 | Comer | 248/243 |
| 2,622,834 | A | * | 12/1952 | Sparring | 248/243 |
| 2,691,502 | A | * | 10/1954 | Jones | 248/243 |
| 2,956,766 | A | * | 10/1960 | Galassi | 248/243 |
| 3,082,880 | A | * | 3/1963 | Mapson | 108/32 |
| 3,092,047 | A | * | 6/1963 | Chesley | 108/137 |
| 3,321,089 | A | * | 5/1967 | Krikorian | 211/134 |
| 3,353,684 | A | * | 11/1967 | Chesley | 211/187 |
| 3,603,274 | A | * | 9/1971 | Ferdinand et al. | 108/108 |
| 3,604,669 | A | * | 9/1971 | Asher | 248/243 |
| 3,701,325 | A | * | 10/1972 | Fenwick | 108/1 |

(Continued)

FOREIGN PATENT DOCUMENTS

| | | |
|---|---|---|
| DK | 81527 | 7/1956 |

(Continued)

*Primary Examiner*—Kimberly Wood
*Assistant Examiner*—Amy J. Sterling
(74) *Attorney, Agent, or Firm*—Buchanan Ingersoll PC

(57) ABSTRACT

A shelf system for releasable mounting of shelves in a supporting element which is essentially vertically positioned and has slots or grooves. Plate-shaped shelf brackets are adapted to support the shelves and are by means of hook-shaped portions adapted to be inserted into a chosen slot for sustaining the shelf brackets in the supporting elements. A locking element releasably locks each shelf bracket on the support element. The hook-shaped portion has a fastening end which is directed upwards in the mounting position of the shelf bracket and is defined by a recess in the shelf bracket. The hook-shaped portion has a base length which corresponds to the height of the slot. The shelf bracket is adapted to be applied obliquely from above in the supporting element and, subsequently, be pivoted in place downwards. The recess has a width that is greater than the material thickness of the supporting element in the slot area for releasable receiving of the locking element, which is adapted to be positioned perpendicular to the plane of the shelf bracket and which prevents the shelf bracket from being pivoted in relation to the supporting element, whereby the shelf bracket is releasably locked on the supported element.

13 Claims, 1 Drawing Sheet

Figure 1:
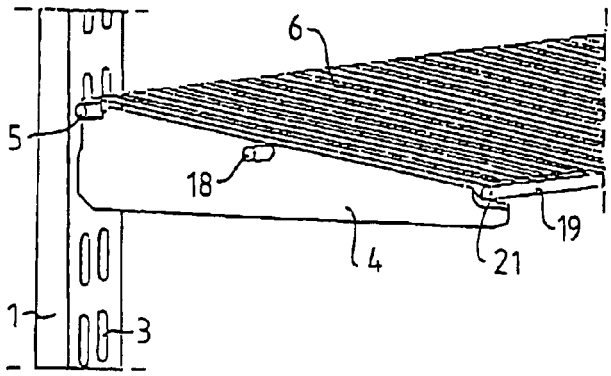

U.S. PATENT DOCUMENTS 3,848,844 A * 11/1974 Barrett ..... 248/245
4,008,873 A * 2/1977 Travaglio et al. ..... 248/242
4,065,088 A * 12/1977 Shell ..... 248/242
4,533,056 A 8/1985 Krikorian
4,609,172 A * 9/1986 Dorner ..... 248/222.13
4,624,376 A * 11/1986 Bertram ..... 211/187
4,658,969 A 4/1987 Mastrodicasa
5,185,971 A * 2/1993 Johnson, Jr. ..... 52/36.6
5,346,077 A * 9/1994 Randall ..... 211/90.03
5,613,449 A * 3/1997 Pullman ..... 108/108
6,024,333 A * 2/2000 Raasch et al. ..... 248/247
6,138,584 A * 10/2000 Waite ..... 108/108
6,164,709 A * 12/2000 Kuczynski et al. ..... 293/109
6,402,108 B1 * 6/2002 Remmers ..... 248/243

FOREIGN PATENT DOCUMENTS

GB 2194134 3/1988
SE 433 801 6/1984

* cited by examiner

LOCKABLE SHELF BRACKET

The present invention relates to a shelf system for releasable mounting of shelves, boards or the like on a wall, or standing by itself, comprising at least one supporting element which is essentially vertically positioned and has slots or grooves, at least one plate-shaped shelf bracket which is adapted to support said shelf, board or the like and which by means of a hook-shaped portion is adapted to be inserted into a chosen slot and engage with an area of the supporting element adjacent to the slot for sustaining the shelf bracket in the supporting element and a locking element for releasable locking of the shelf bracket on the supporting element. The invention also relates to a shelf bracket which is included in the system and a locking element included therein.

More particularly, the invention primarily relates to a shelf system which is adapted to be attached to a wall and which comprises a suspending strip which is secured by screws in the wall and from which a number of hanging rails of U-shaped cross-section are suspended. The hanging rails are formed with rows of slots, in which shelf brackets may be arranged in order to support, in pairs, a shelf or the like at an optional height.

Swedish published patent application 433 801 discloses a U-shaped lockable shelf bracket. The shelf bracket is adapted to be suspended from a rail that is fixed to the wall and is formed with keyhole openings, in which a respective end of the shelf bracket is insertable. In this connection, the shelf bracket is fixed by means of a groove in each end that cooperates with the edge portion of a respective opening. The shelf bracket is locked in place by means of a washer which is inserted into the upper portion of the keyhole opening. The tubular shelf bracket is, because of its construction, conspicuous and relatively expensive to manufacture. Furthermore, the locking washer is not tamper-proof, in that a child who is unable to let things alone can make it come loose and then by mistake may detach the shelf bracket from the rail and get the shelf on him or her at the risk of being injured.

Danish patent specification 81572 illustrates a plate-shaped shelf bracket with a hook-shaped portion which is adapted to be inserted and fixed in a slot in a U-shaped rail which is attached to a wall. The shelf bracket is fixed in place by a shelf being secured on the shelf bracket by screws, the internal edge of the shelf abutting against the rail and preventing the shelf bracket from turning round the hook portion. It is thus a complicated procedure to lock the shelf bracket to the rail or to move an already mounted shelf due to the fact that a number of screws have to be loosened from or be secured in the shelf.

Also British patent application 2 194 134 shows a lockable shelf bracket construction that mainly functions as the one according to the above Danish patent specification. In a variant of the Danish shelf bracket, detached (separate) hook elements are used which prevent turning of the shelf bracket round the hook portion. Each hook element has a pair of lugs adapted to be inserted into the same slots in a suspending strip, into which both the hook portions of the shelf bracket are inserted. In this way, the shelf bracket is prevented from being detached from the suspending strip. The hook element is, in its turn, kept in place by a shelf being wedged between the upper portion of the hook element which protrudes perpendicular to the suspending strip and the upper portion of the shelf bracket, and in order to obtain safe attachment of the shelf to the shelf brackets, the shelf is fastened by screws therein. In other words, screw joints are required also in this case in order to secure the shelf.

The object of the present invention is to provide a shelf system with-such components that its shelves, boards or the like may be locked, safely and easily and in a readily detachable manner to vertically positioned supporting elements.

Another object of the invention is to provide a shelf system with components that are inexpensive to manufacture and which are slender and not conspicuous.

Yet another object is to Provide a shelf system with locking elements that are attached to or formed integrally with the shelves.

According to the invention, these objects are achieved by means of a shelf system, shelf brackets included in the system and locking elements which are defined in independent claims 1, 2 and 8.

Further developments of the invention are evident from the features that are stated in the subclaims.

Figure 2:
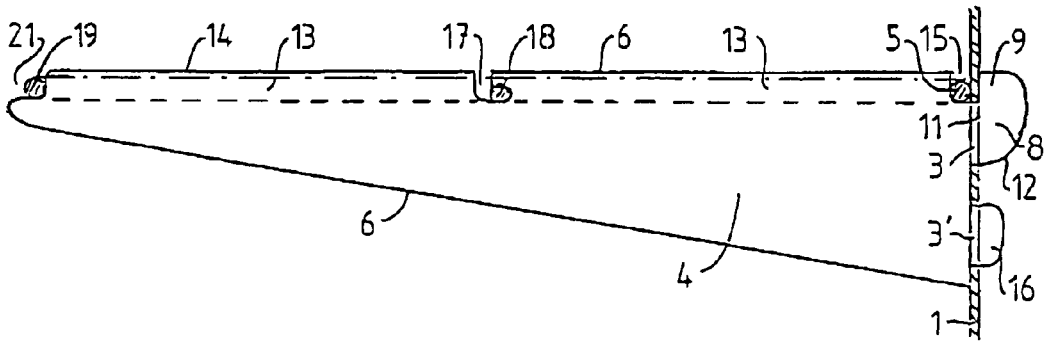
Figure 3:
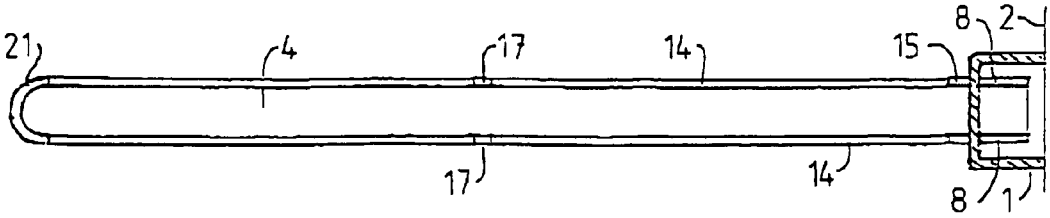

Preferred embodiments of the invention will now be illustrated by way of example with reference to the accompanying drawings, in which FIG. 1 is a perspective view of part of the shelf system according to the invention in its mounted position, FIG. 2 is a side view, partly in cross-section, of the shelf system according to FIG. 1, and FIG. 3 is a top plan view, partly in cross-section, of an embodiment of the shelf bracket of the shelf system, the shelf bracket being mounted in its sustaining rail.

With reference first to FIG. 1, which in perspective shows a portion of the shelf system according to the invention, the shelf system comprises a per se known, essentially vertically positioned supporting element 1. The supporting element may be free-standing or supported by a pair of feet resting on a base, for example a floor (not shown). However, it is preferred that the supporting element is a rail or sectional element which is attached to or formed integrally with a wall 2. The supporting element 1 is preferably formed as a U-shaped rail secured by screws to the wall 2 or comprises a sustaining rail which is suspended from a suspending strip attached to the wall, as shown in the Elfa leaflet "Planerings-och produktguide" (in English: "Planning and Product Guide").

The supporting element or the rail 1 is provided with two parallel rows of slots or grooves 3 of the same dimensions and equidistantly spaced from each other in the longitudinal direction. The supporting element 1 may alternatively be formed with a single row of slots or grooves.

The shelf system also comprises a number of new and plate-shaped shelf brackets 4 and locking elements 5 in the form of more or less elongated bodies.

The shelf bracket 4 is adapted to releasably support, on its own or together with a further shelf bracket, a shelf, board or the like 6, as has been schematically indicated by means of a dash-dot line in FIG. 2. The shelf bracket is preferably made of a single sheet or a plate of metal or some other suitable material or a sheet which is bent in U-shape or the like, cf. FIG. 3. In the last-mentioned case, the bend 6 is arranged in the lower part of the shelf bracket 4 (in its mounted state) and its free ends in the upper part as is evident from FIG. 3.

Irrespective of the form of the shelf bracket 4, it exhibits at one end a respective hook-shaped, protruding portion 8, which is adapted to be inserted into a chosen slot 3 in the supporting element or rail 1 and engage with an area inside the supporting element adjacent to the slot 3 for sustaining the shelf bracket in the supporting element, as illustrated in FIG. 2. The hook-shaped portion 8 has a fastening end or hook portion 9, which is directed upwards in the mounted state of the shelf bracket, and a base 11, the length of which corresponds to the height of the slot 3. An essentially arcuate circumferential surface 12 ends the hook-shaped portion 8. The shelf-supporting portion 13 of the shelf bracket extending between the ends thereof terminates in an upper circumferential surface 14, to the level of which the fastening end 9 extends.

The fastening end 9 is defined by said circumferential surface 12, as well as by a recess 15 that extends from the upper circumferential surface 14 and into the shelf supporting portion 13 of the shelf bracket. The recess 15 has a width that is greater than the thickness of the supporting element 1 in the area of the slot 3, which enables, apart from the supporting element 1, also a locking element 5 to be releasably received in the recess 15, see FIG. 2. The locking element 5 is adapted to be positioned perpendicular to the longitudinal axis of the shelf bracket adjacent to the supporting element and has preferably a cross-section of such dimensions that the locking element fills the free space of the recess. In this way, the shelf bracket is prevented from being pivoted in relation to the supporting element and is thus fixedly attached to the same, as will be discussed in more detail in the following.

The locking element 5 may be a separate element but is preferably attached to or formed integrally with the shelf 6, cf. FIG. 1.

In order to be able to more firmly attach the shelf bracket 4 to the supporting element 1, especially if the shelf bracket is made of a single sheet or plate (not bent to U-shape), a guiding lug 16 is formed to protrude at the end of the shelf bracket with the hook-shaped portion 6, at a distance therefrom that corresponds to the mutual distance of the slots 3. The guiding lug (lugs) 16 is (are) adapted to be inserted into a separate slot (separate slots) in the supporting element 1, see FIG. 2.

In the above embodiments of the invention, the shelf brackets 4 may be locked to the supporting element 1 in a detachable manner. However, they are not completely childproof since a child who is unable to let things alone may remove the locking element 5, after which the shelf bracket may be detached from the supporting element. In order to eliminate the risk that this will happen, a groove 17 is formed in the shelf supporting portion 13 of the shelf bracket 4, at the free end (not shown) of the shelf bracket or preferably between the ends of the shelf brackets. The groove 17 extends mainly in the longitudinal direction of the shelf bracket and in a direction towards the recess 15. Advantageously, the bottom of the groove is at the same level as the bottom of the recess 15 indicated by means of a dashed line in FIG. 2. An attaching element 18 which cooperates with the groove 17 is in this case arranged on, or formed integrally with, the shelf 6 parallel with and at a distance from the locking element 5 which corresponds to the distance between the recess 15 and the innermost portion of the groove 17, see FIG. 2. The attaching element 18 is somewhat elastic or resilient or is attached to a shelf 6 in a yieldable manner, so that it can be inserted into the groove 17 as the shelf and the locking element 5 during insertion are sliding on the upper circumferential portion of the shelf bracket when mounting the shelf on the shelf bracket. In the case where the shelf 6 is latticed instead of being homogeneous, as shown in FIG. 1, the inherent elasticity of the shelf is adequate as regards the mounting process.

It is advantageous when mounting the shelves on the shelf brackets that the shelves are symmetric. Thus, a terminating element 19 has been arranged at the long side of the shelf 6 opposite to the long side with the locking element 5, the terminating element being parallel with the locking element 5 and with the attaching element 18. It is also possible to double the locking element 5 and the terminating element 19 by arranging the additional elements on the opposite side of the shelf, opposite to the locking element and the terminating element, respectively. Half-way between the terminating element 19 and the locking element 5, the attaching element 18 is arranged, which controls the positioning of the groove 17. In connection with the mounting, the terminating element 19 is received in a recessed portion 21 at the free end of the shelf bracket 4, the bottom of which is on the same level as the bottom of the groove 17 and the recess 15, said bottom being indicated by a dashed line in FIG. 2.

Mounting of the shelf system is carried out as follows. When the supporting elements or rails 1 have been put in place as described above, the hook-shaped portion 8 of the respective shelf brackets is inserted obliquely from above into a selected slot 3, after which the shelf bracket 4 is pivoted downwards, so that the fastening end 9 hooks into the area above the slot 3 and the entire hook-shaped portion is inserted into the supporting element through the slot, the circumferential surface 12 sliding along the lowest portion of the slot. At the same time, the optional guiding lug 16 is guided into the subjacent slot 3'. The shelf 6 is then placed on the top of the shelf bracket 4 and the attaching element 18 is pressed into the opening of the groove 17, after which the shelf is displaced towards the supporting element 1 until the locking element 5 snaps into the recess 15 and locks the shelf bracket 4, as well as the shelf 6, in place, by the attaching means 18 being moved simultaneously to the innermost portion of the groove 17. The obtained locking is now so strong that neither the shelf nor the shelf bracket can be unintentionally detached, for example by being pushed or hit, or by being tampered with by a child.

The invention is not limited to that described above or to that shown in the drawings, but can be changed within the scope of the appended claims,

What is claimed is:

1. A shelf system for releasable mounting of shelves or boards on a wall or standing by itself, said shelf system comprising:

at least one supporting element which is essentially vertically positioned and has slots or grooves, at least one plate-shaped shelf bracket having a longitudinal plane which is adapted to support said shelf or board and which by means of a hook-shaped portion projecting from one end of said shelf bracket is adapted to be inserted into a chosen slot and engage with an area of the supporting element adjacent to the slot for sustaining the shelf bracket in the supporting element, and a locking element for releasable locking of the shelf bracket on the supporting element, wherein the hook-shaped portion has a fastening end which is directed upwards in a mounting position of the shelf bracket and is defined by a recess in the shelf bracket and by an essentially arc-shaped circumferential surface extending downwards from the uppermost portion of the recess and terminating at said end of said shelf bracket, wherein the distance between the termination of said circumferential surface and the recess corresponds to the height of the slot in order to enable the hook shaped portion to fit through the slot, wherein the shelf bracket is adapted to be applied obliquely from above into the supporting element and subsequently be pivoted in place downwards, and wherein the recess has a width that is greater than the material thickness of the supporting element in said slot area for releasable receiving of the locking element, which locking element is adapted to be positioned perpendicular to the longitudinal plane of the shelf bracket and the width of the recess is small enough such that the recess engages with the locking element to prevent the shelf bracket from being unintentionally detached from the supporting element when the locking element is in the recess, whereby the shelf bracket is locked in a releasable manner on the supporting element.

2. In combination a plate-shaped shelf bracket for detachable mounting of shelves and boards on a supporting element which supporting element is essentially vertically positioned and has at least one slot therein or grooves, the shelf bracket comprising:

a shelf-supporting portion terminating at the opposite ends of the shelf bracket, and having at its one end a hook-shaped, protruding portion which is adapted to be inserted into the slot and engage with an area of the supporting element adjacent to the slot for sustaining the shelf bracket in the supporting element, wherein the hook-shaped portion has a fastening end which is directed upwards in the mounting position of the shelf bracket, which is defined by a recess in the shelf bracket and extends essentially to the same level as a circumferential surface of the shelf-supporting portion, wherein said recess is formed in the shelf-supporting portion and is partly defined at one end thereof by the fastening end, and said recess has a width that is greater than a material thickness of the supporting element in said slot area for releasably receiving a locking element, and wherein the width of the recess is small enough such that the recess engages with the locking element to prevent the shelf bracket from being unintentionally detached from the supporting element when the locking element is in the recess, whereby the shelf bracket is locked in a releasable manner on the supporting element wherein the locking element is positioned perpendicular to the longitudinal plane of the shelf bracket.

3. A shelf bracket as claimed in claim 2, wherein a guiding lug is formed to protrude at the end of the shelf bracket having the hook-shaped portion at a distance therefrom, the guiding lug being adapted to be inserted into a slot in the supporting element other than said slot.

4. A shelf bracket as claimed in claim 3, wherein it is formed of a metal sheet which is bent to U-shape, the free ends of which are formed into a respective shelf-supporting portion with an associated hook-shaped portion.

5. A shelf bracket as claimed in claim 4, wherein each guiding lug is formed to protrude at the end of the shelf bracket having said hook-shaped portion.

6. A shelf bracket as claimed in claim 2, further comprising a groove in the shelf-supporting portion of the shelf bracket between the ends of the shelf bracket, said groove extending essentially in the longitudinal direction of the shelf bracket and the bottom of said groove being on the same level as the bottom of the recess.

7. A shelf bracket as claimed in claim 6, further comprising a recessed portion at the free end of the shelf bracket, the bottom of the free end being on said same level.

8. A shelf bracket as claimed in claim 3, further comprising a groove in the shelf-supporting portion of the shelf bracket between the ends of the shelf bracket, said groove extending essentially in the longitudinal direction of the shelf bracket and the bottom of said groove being on the same level as the bottom of the recess.

9. A shelf bracket as claimed in claim 4, further comprising a groove in the shelf-supporting portion of the shelf bracket between the ends of the shelf bracket, said groove extending essentially in the longitudinal direction of the shelf bracket and the bottom of said groove being on the same level as the bottom of the recess.

10. A shelf bracket as claimed in claim 5, further comprising a groove in the shelf-supporting portion of the shelf bracket between the ends of the shelf bracket, said groove extending essentially in the longitudinal direction of the shelf bracket and the bottom of said groove being on the same level as the bottom of the recess.

11. A shelf bracket as claimed in claim 8, further comprising a recessed portion at the free end of the shelf bracket, the bottom of the free end beginning on said same level.

12. A shelf bracket as claimed in claim 9, further comprising a recessed portion at the free end of the shelf bracket, the bottom of the free end beginning on said same level.

13. A shelf bracket as claimed in claim 10, further comprising a recessed portion at the free end of the shelf bracket, the bottom of the free end beginning on said same level.

* * * * *